United States Patent [19]

Rosenberg

[11] 4,290,557

[45] Sep. 22, 1981

[54] SPRINKLERS

[76] Inventor: Avner Rosenberg, Moshav Beit Shearim, Israel

[21] Appl. No.: 124,220

[22] Filed: Feb. 25, 1980

[51] Int. Cl.[3] ..... B05B 3/04

[52] U.S. Cl. ..... 239/222.21; 239/383; 239/453; 239/464; 239/499; 239/506

[58] Field of Search ..... 239/222.19, 222.21, 239/380-383, 505, 506, 512, 514, 520, 524, 453, 454, 464, 486, 499, DIG. 16, DIG. 20, 222.17

[56] References Cited

U.S. PATENT DOCUMENTS

| | | | |
|---|---|---|---|
| 1,899,711 | 2/1933 | Munz | 239/506 |
| 3,034,728 | 5/1962 | Hruby, Jr. | 239/222.21 |
| 3,312,400 | 4/1967 | Clearman | 239/222.21 |
| 3,958,760 | 5/1976 | Rosenberg | 239/453 |
| 4,121,769 | 10/1978 | Prori | 239/222.17 |

FOREIGN PATENT DOCUMENTS

| | | | |
|---|---|---|---|
| 139895 | 11/1880 | France | 239/222.17 |

*Primary Examiner*—Andres Kashnikow
*Assistant Examiner*—Michael J. Forman
*Attorney, Agent, or Firm*—Benjamin J. Barish

[57] ABSTRACT

A sprinkler is described comprising a nozzle formed with an axial bore having an outlet through which the liquid exits in the form of a jet, a spindle extending through the bore and having a smaller outer diameter than the diameter of the bore so as to be laterally movable within the bore, and a deflector mounted on the spindle and having a recess facing, and slightly larger than, the outlet end of the nozzle bore so as to be impinged by the jet issuing from the nozzle thereby to impart rapid lateral movements to the spindle. The deflector is eccentrically mounted on the spindle, and the recess is formed eccentrically of the deflector, such that the impacts of the spindle against the sides of the bore by its lateral movement within the bore impart a rotary movement to the deflector.

9 Claims, 8 Drawing Figures

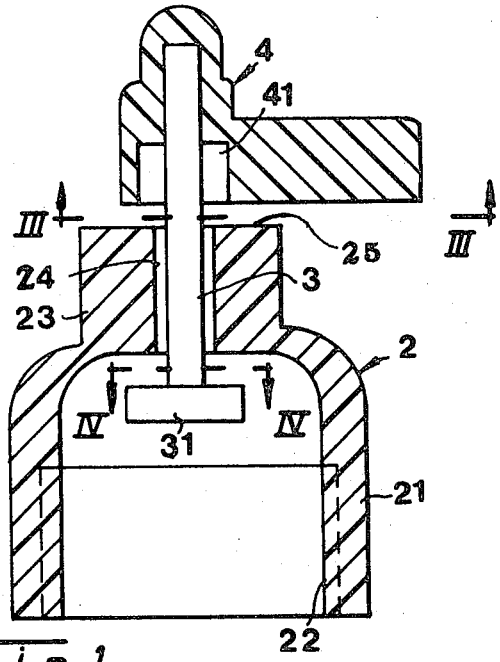
Fig. 1
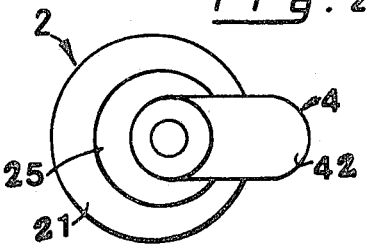
Fig. 2
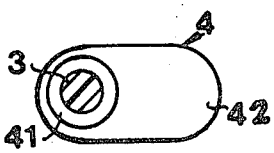
Fig. 3
Fig. 4
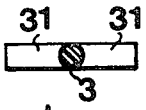
Fig. 5
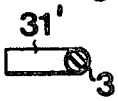
Fig. 6
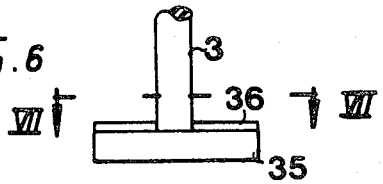
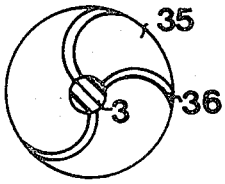
Fig. 7
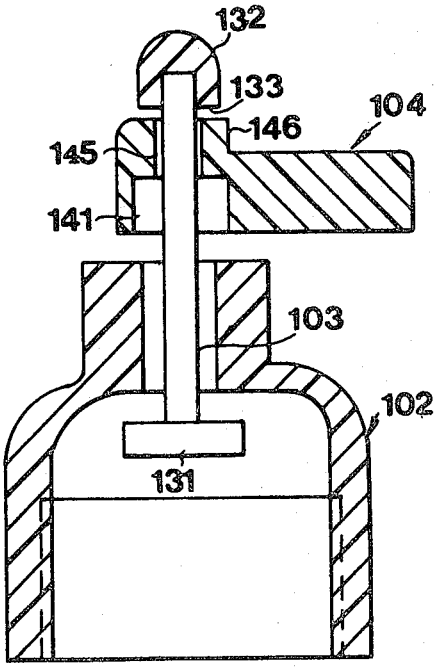
Fig. 8

SPRINKLERS

BACKGROUND OF THE INVENTION

The present invention relates to sprinklers, and particularly to water irrigation sprinklers.

Many different types of sprinklers are presently used for water irrigation. Thus, there is the impact or hammer type sprinkler which produces a long-range jet rotating (or oscillating) at a relatively low velocity, e.g. in the order of up to 10 RPM, the rotary movement (continuous rotation or oscillation) being effected by impact forces. A second type, commonly called a whirling sprinkler, produces a shorter-range jet rotating, usually by reaction forces, much faster, in the order of several hundred RPM's. A third type, sometimes called a mini-sprinkler or sprayer, is a static device which produces no rotating jet but rather a spray of fine water droplets immediately around the sprinkler; an example of the latter is illustrated in U.S. Pat. No. 3,958,760.

The known sprinklers frequently suffer from a number of drawbacks, including non-uniformity in the distribution of the water around the sprinkler, high-sensitivity to clogging by solid particles in the irrigation water, and/or high tolerance requirements in the manufacturing of the parts. These drawbacks may not only affect the efficiency of the sprinklers, but may also increase their initial and maintenance costs and shorten their useful lives.

An object of the present invention is to provide a sprinkler having advantages in the above respects, as will be more particularly pointed out below.

SUMMARY OF THE INVENTION

The invention is directed to the type of sprinkler comprising a nozzle connectable to a pressurized-liquid supply pipe and formed with an axial bore having an outlet through which the liquid exits in the form of a jet; a spindle extending through the bore and projecting outwardly of the outlet end thereof, the spindle including means having a smaller outer diameter than the diameter of the bore so as to be laterally movable within the bore; and a deflector mounted on the spindle and having a recess facing, and slightly larger than, the outlet end of the nozzle bore so as to be impinged by the jet issuing from the nozzle and thereby to impart rapid lateral movements to the spindle within the bore.

The invention exploits the lateral movements of the spindle within the bore for effecting a rotary movement of the deflector, and thereby of the water spray produced by it. For this purpose, the deflector is eccentrically mounted on the spindle, and the recess is formed eccentrically of the deflector such that the rapid lateral movements of the spindle cause it to impact against the sides of the bore which impacts, due to the above eccentricities, impart a rotary movement to the deflector.

Two embodiments of the invention are described below for purposes of example. In both embodiments, the spindle is formed of a length longer than that of the bore and is axially, as well as laterally, movable within the bore, the spindle further including an inner stop engageable with the nozzle for limiting the outward movement of the spindle with respect to the bore.

In one described embodiment, the deflector is fixedly mounted to the spindle. This application of the invention would provide a sprinkler most closely resembling the third type sprinkler (mini-spinklr or sprayer) mentioned above, except that instead of being a static device, a rotary movement is applied to the spray by the deflector rotating (or oscillating) at a relatively low velocity similar to the first type sprinkler (impact or hammer) mentioned above. Such an arrangement provides important advantages over the known static mini-spinklers or sprayers: Thus, it produces a more uniform distribution of the fine water droplets around the sprinkler since the deflector is continuously rotated, and therefore any imprecision in the dimensioning of the parts, which might tend to produce more distribution on one side of a static device than on the other side, is compensated by the rotation of the deflector. Moreover, the rotation of the deflector tends to free it of any clogging particles, thereby reducing its sensitivity to clogging. In addition, this arrangement reduces the tolerance requirements in the manufacturing of the parts, thereby decreasing both the initial costs and the maintenance costs, and also increasing the useful life of the sprinkler.

In a second described embodiment, the deflector is floatingly mounted on the spindle for rotatable and axial movement thereon, the spindle further including an outer stop engageable by the deflector for limiting its outward movement. Preferably, the deflector is formed with an opening of a slightly larger diameter than the outer diameter of the spindle and with an annular bead surrounding its opening for substantially sealingly engaging the outer spindle stop. Such an arrangement is most closely-related to the second type of sprinkler mentioned above, namely the whirling sprinkler, except that it too exhibits less sensitivity to clogging, more uniformity in the water distribution, and lower part-tolerance requirements, for similar reasons as discussed above.

Further features and advantages of the invention will be apparent from the description below.

BRIEF DESCRIPTION OF THE DRAWINGS

The invention is herein described, by way of example only, with reference to the accompanying drawings, wherein:

FIG. 1 is a longitudinal sectional view, illustrating one form of sprinkler constructed in accordance with the invention;

FIG. 2 is a top plan view of the sprinkler of FIG. 1;

FIG. 3 is a sectional view along lines III—III of FIG. 1;

FIG. 4 is a sectional view along lines IV—IV of FIG. 1;

FIG. 5 is a view similar to that of FIG. 4 but illustrating a variation;

FIG. 6 is a fragmentary view illustrating a further variation;

FIG. 7 is a sectional view along lines VII—VII of FIG. 6; and

FIG. 8 is a longitudinal sectional view illustrating another form of sprinkler constructed in accordance with the invention.

DESCRIPTION OF PREFERRED EMBODIMENTS

The embodiment of the invention illustrated in FIGS. 1–4 is most closely related to the third type of sprinkler of those discussed above, namely the mini-sprinkler or sprayer, particularly of the type illustrated in U.S. Pat. No. 3,958,760, except that instead of being a static device, it is a dynamic device in that the spray produced around the sprinkler is caused to rotate at a relatively low-velocity, as in the first-mentioned (hammer or impact) type of sprinkler discussed above.

The sprinkler illustrated in FIGS. 1–4 includes three main elements, namely a nozzle generally designated 2, a stem or spindle generally designated 3 carried by the nozzle, and a deflector generally designated 4 carried by the latter.

The nozzle 2 is formed with a cylindrical coupling end 21 internally threaded at 22 for coupling same to a pressurized-liquid supply pipe (not shown). The opposite end 23 of nozzle 2 is of reduced diameter and is formed with an axial bore 24 whose inner end inlets the liquid from the supply pipe and outer end outlets the liquid in the form of a jet. The outer face 25 of nozzle 2 is preferably flat (as shown), but may, if desired, be formed with an outwardly-inclined outer marginal rim for inclined spraying, as known in the art.

Spindle 3, extending through bore 24, is of cylindrical configuration and has an outer diameter smaller than that of the diameter of bore 24 so as to be laterally movable within the bore. In addition, spindle 3 has a length longer than that of bore 24 so as also to be axially movable within the bore. The inner end of the spindle is formed with an inner stop in the form of a cross-bar 31 (also see FIG. 4) engageable with the inner face of nozzle 2 for limiting the outward movement of the spindle with respect to the bore.

Insofar as described above, the sprinkler illustrated in FIGS. 1–4 is similar to that of the above-cited U.S. Pat. No. 3,958,760. As distinguished from the spinkler of that Patent, however, the deflector 4 in the sprinkler of FIGS. 1–4 is not centrally mounted on spindle 3, but rather is eccentrically mounted on the spindle, as can be seen particularly in FIG. 3. Moreover, the recess 41, formed in the lower surface of the deflector facing and slightly larger than the outlet end of the nozzle bore 24 so as to be impinged by the jet issuing from the nozzle, is also formed eccentrically of the deflector rather than centrally thereof as in the above-cited Patent.

More particularly, the lower face of the deflector 4, as seen especially in FIG. 3, is of substantially rectangular configuration with rounded ends, rather than of circular configuration, and has a length substantially greater than its width. For example, its length may be about twice that of its width. Both the mounting of the deflector on the spindle 3, and the provision of the recess 41 in the lower face of the deflector, are at one end of the deflector rather than centrally thereof as mentioned above. The mounting of the deflector to the spindle may be a friction-fit, and for this purpose the lower face of deflector 4 is formed with a blind bore frictionally receiving the upper end of spindle 3. The remaining portion of the lower face of deflector 4 is preferably flat as shown at 42 in FIG. 3.

The sprinkler illustrated in FIGS. 1–4 operates as follows:

When no water jet issues from the nozzle bore 24, the spindle 3 and deflector 4 both drop by gravity, so that the deflector covers the open end of the nozzle bore 24 and thereby protects same against the entry of dirt particles, insects, and like.

As soon as pressurized water is applied to the nozzle, the water passes through the bore 24 and issues therefrom in the form of a jet impinging deflector recess 41. This first raises the deflector and its spindle 3 until limited by the inner stop 31 of the spindle so as to uncover the outlet end of nozzle bore 24. The impingement of the jet within recess 41 also imparts a rapid reciprocating movement to the spindle 3 laterally within nozzle bore 24, this being permitted by the fact that the spindle diameter is less than that of the bore. Since the deflector is eccentrically mounted to the spindle, these rapid lateral movements of the spindle cause it to impact against the sides of the bore, which impacts, due to the above eccentricity, impart a rotary moment to the deflector. Thus, the deflector 4, and also its spindle 3 fixed to it, will rotate at a relatively low velocity around the nozzle similar to the hammer-type or impact-type sprinklers briefly mentioned above.

The rotary movements produced by the rapid lateral reciprocations of the spindle 3 within the nozzle bore 24 will be affected by the construction of the inner spindle stop 31. Thus, when the inner stop 31 is of the illustrated cross-bar construction, this provides two diametrically-opposed contact points engageable with the nozzle for limiting the outward movement of the spindle 2 with respect to the nozzle bore 24. This permits the spindle to tilt along one axis, namely the axis at right angles to that of the cross-bar 31, as it impacts the sides of the nozzle bore.

To enhance the rotary movement produced by the impacts, the inner stop may be formed with but one contact point engageable with the nozzle for limiting the outward movement of the spindle with respect to the bore. This is illustrated in FIG. 5 wherein the cross-bar includes only one leg 31′ rather than the two legs 31 illustrated in FIGS. 1 and 4. This permits more tilting of the spindle, producing greater impact forces and therefore larger rotary moments.

Another manner of enhancing the rotary movement of the deflector is illustrated in FIGS. 6 and 7, wherein it will be seen that the spindle 3 is provided with an inner stop 35 in the form of a disc and having a plurality of curved vanes 36 on its upper face. Thus, the water, before entering the inlet end of the nozzle bore 24 (FIG. 1), streams past the vanes 36 and imparts thereby a rotary force to the spindle, enhancing the above-described rotary movement produced by the eccentric impacts of the spindle on the sides of the nozzle bore 24.

It will thus be seen that the sprinkler illustrated in FIGS. 1–4, including its variations of FIGS. 5–7, will produce a slowly-rotating spray and will therefore provide the advantages discussed above over the static-type sprinkler, including more uniformity in the distribution of the water around the sprinkler, a lower sensitivity to clogging by solid particles in the irrigation water, and lower tolerance requirements in the manufacture of the parts.

FIG. 8 illustrates a further embodiment of the invention also including a nozzle 102, a spindle 103, and a deflector 104. The deflector 104, however, instead of being fixedly-mounted to the spindle 103 as in the above described embodiment, is floatingly mounted to the spindle. For this purpose, the deflector 104 is formed with an opening 145 extending through it and its eccentric recess 141 (corresponding to recess 41 in FIG. 1), which opening 145 is of larger diameter than the outer diameter of spindle 103. The spindle 103 further includes, in addition to its inner stop 131, also an outer stop 132 in the form of a cap having a blind bore frictionally receiving the upper end of the spindle. The lower face 133 of the cap 132 is preferably flat and engages the upper flat face of an annular bead 146 projecting outwardly from the upper face of deflector 104 around its opening 145.

It will thus be seen that deflector 104 in FIG. 8, although eccentrically-mounted to the spindle 103 and provided with the eccentric recess 141 impinged by the jet as in FIG. 1, is free to rotate about spindle 103 and is also free to move axially of the spindle. When the deflector, particularly its recess 141, is impinged by the water jet issuing from nozzle 102, the eccentric mounting of the deflector on the spindle 103 imparts a rotary moment to the deflector as described above. Since the deflector is floatingly mounted to the spindle, this rotary moment produces a higher speed rotation of the deflector than in the above-described embodiment.

During the above described operation of the sprinkler, the deflector 104 is pressed against the outer-limit cap 132, such that the flat face 133 of the cap engages the flat face of the annular bead 146 of the deflector 104, substantially sealing the clearance between its opening 145 and the outer face of spindle 103. Thus, the sprinkler of FIG. 8 performs similar to the whirling type sprinkler mentioned above except that it too exhibits less sensitivity to clogging, more uniformity in the water distribution, and lower part-tolerance requirements.

It will be appreciated that the invention could also be embodied in an arrangement wherein the rotary moments applied to the deflector, particularly the fixedly-mounted type, could be used to impart an oscillating movement to the deflector, rather than a continuously rotating movement, as known in the art.

Many other variations, modifications and applications of the invention will be apparent.

What is claimed is:

1. A sprinkler comprising:

a nozzle connectable to a pressurized-liquid supply pipe and formed with an axial bore having an inlet end for inletting the liquid from the supply pipe and an outlet end through which the liquid exits in the form of a jet;

a spindle extending through the bore and projecting outwardly of the outlet end thereof, said spindle including means for retaining same within the bore but having a smaller outer diameter than the diameter of said bore so as to be laterally movable within said bore;

and a deflector mounted on said spindle and having a recess facing, and slightly larger than, the outlet end of said nozzle bore so as to be impinged by the jet issuing from the nozzle and thereby to impart rapid lateral movements to the spindle causing the spindle to impact against the sides of the bore;

characterized in that said deflector is eccentrically mounted on said spindle, and said recess is formed eccentrically of said deflector, such that the impacts of the spindle against the sides of the bore impart a rotary movement to the deflector during impingement of the jet on the deflector.

2. The sprinkler according to claim 1, wherein said spindle has a length longer than that of said bore and is axially, as well as laterally, movable within the bore, said spindle further including an inner stop engageable with said nozzle for limiting the outward movement of the spindle with respect to said bore.

3. The sprinkler according to claim 2, wherein said inner stop has two diametrically-opposed contact points engageable with said nozzle for limiting the outward movement of the spindle with respect to said bore.

4. The sprinkler according to claim 2, wherein said inner stop has one contact point engageable with said nozzle for limiting the outward movement of the spindle with respect to said bore.

5. The sprinkler according to claim 2, wherein said inner stop includes curved vanes on its upper surface to enhance said rotary movement to the deflector.

6. The sprinkler according to claim 5, wherein said inner stop is of a disc configuration on its lower face.

7. The sprinkler according to claim 1, wherein said deflector is fixedly mounted to said spindle.

8. The sprinkler according to claim 1, wherein said deflector is floatingly mounted on said spindle for rotatable and axial movement thereon by means of an opening extending through the deflector and its eccentric recess which opening is of slightly larger diameter than the outer diameter of the spindle, said spindle further including an outer stop engageable by the deflector for limiting its outward movement on the spindle.

9. The sprinkler according to claim 8, wherein the outer face of the deflector is formed with an annular bead surrounding said opening and projecting outwardly thereof for engaging said outer stop in a substantially sealing manner.

* * * * *